United States Patent [19]

Culjkovic

[11] Patent Number: 4,720,404

[45] Date of Patent: Jan. 19, 1988

[54] AQUEOUS ALKALINE BATH FOR THE CHEMICAL DEPOSITION OF COPPER, NICKEL, COBALT AND THEIR ALLOYS

[76] Inventor: Josif Culjkovic, Gossler Str. 3, 1000 Berlin 33, Fed. Rep. of Germany

[21] Appl. No.: 896,741

[22] Filed: Aug. 7, 1986

Related U.S. Application Data

[63] Continuation of Ser. No. 693,803, Jan. 23, 1985, abandoned.

[30] Foreign Application Priority Data

Feb. 4, 1984 [DE] Fed. Rep. of Germany ..... 3404270

[51] Int. Cl.[4] ..... C23C 18/40

[52] U.S. Cl. ..... 427/98; 106/1.22; 106/1.23; 106/1.27; 427/443.1

[58] Field of Search ..... 427/98, 443.1; 106/1.22, 1.23, 1.26

[56] References Cited

U.S. PATENT DOCUMENTS

| | | | |
|---|---|---|---|
| 2,430,581 | 11/1947 | Pessel | 106/1.22 |
| 2,938,805 | 5/1960 | Agens | 106/1.26 |
| 3,095,309 | 6/1963 | Zeblisky | 106/1.26 |
| 3,383,224 | 5/1968 | Dutkewych | 106/1.26 |
| 3,472,660 | 10/1969 | Bastenbeck | 106/1.26 |
| 3,615,735 | 10/1971 | Shipley | 106/1.22 |

FOREIGN PATENT DOCUMENTS

| | | | |
|---|---|---|---|
| 1332307 | 10/1973 | United Kingdom | 106/1.26 |
| 740860 | 6/1980 | U.S.S.R. | 106/1.22 |

*Primary Examiner*—John D. Smith

*Attorney, Agent, or Firm*—Michael J. Striker

[57] ABSTRACT

An aqueous alkaline bath is disclosed, for the adhesive chemical (electroless) deposition of copper, nickel, cobalt or their alloys with great purity, containing compounds of these metals, reducing agent, wetting agent, pH-regulating substance, stabilizer, inhibitor and complex former, characterized in that polyols and/or compounds of the biuret type are contained as complex former, as well as a method for the adhesive chemical deposition of the metals, employing this bath at a temperature from 5° C. up to the boiling point of the bath, particularly for the manufacture of printed circuits.

11 Claims, No Drawings

AQUEOUS ALKALINE BATH FOR THE CHEMICAL DEPOSITION OF COPPER, NICKEL, COBALT AND THEIR ALLOYS

This is a continuation of application Ser. No. 693,803, filed Jan. 23, 1985, now abandoned.

BACKGROUND OF THE INVENTION

The invention concerns an aqueous alkaline bath for the chemical deposition of copper, nickel, cobalt or their alloys, containing compounds of these metals, reducing agent, wetting agent, pH-regulating substance, stabilizer, inhibitor and complex former, and a method for the adhesive chemical deposition of these metals and alloys.

Baths of the above-designated type are generally known. They contain, as a rule, considerable amounts of complex formers, in order to prevent the precipitation of metal hydroxides. This inevitably leads to an unsatisfactory quality of the coating deposited from these baths, which, indeed according to the type of bath, can contain considerable amounts of impurities, such as carbon, nitrogen and hydrogen, among others, which exert a decisive influence on the crystalline structure and thereby on technologically important characteristics such as specific electrical conductivity, interior voltage, adhesive strength, and dilatability, or ductility. The effect is particularly disturbing, for example, with the production of printed circuit boards, during which undesirable bubbles, disengagements and cracks can form, and indeed the more so, the thicker is the deposited metal layer.

The concentrate, or rinse water, accruing upon operation of the known baths, accumulates mainly in the form of solutions, which can be removed from concern only with great technical expenditure, since their direct attribution in the manufacturing process is not possible without more.

SUMMARY OF THE INVENTION

It is therefore an object of the present invention to provide a bath and a method, which allow for an adhesive chemical deposition of copper, nickel, cobalt and their alloys with greater purity and, at the same time, with technically problem-free recovery of the employed metals.

This object is attained according to the present invention by an aqueous alkaline bath, containing compounds of copper, nickel, cobalt or their alloys, reducing agent, wetting agent, pH-regulating substance, stabilizers, inhibitors, and complex former, characterized in that it contains polyols and/or biuret-type compounds as complex former. In accordance with the present method, such a bath is employed at temperature from 5° C. up to the boiling point, preferably from 20° to 80° C., for the adhesive chemical deposition of copper, nickel, cobalt or their alloys.

Metal coatings of the highest purity can be deposited, surprisingly, from the bath according to the present invention, which is not possible with the known chemical baths.

Thus, for example, the sum of the carbon, hydrogen and nitrogen impurities in the copper coatings deposited according to the present invention is 0.03%, whereas in conventionally deposited coating, impurities are contained of a degree of magnitude of 0.07 to 0.37%.

The quality of the metal coating deposited according to the present invention therefore corresponds to that which is otherwise obtained only by electrolytical deposition of metal. Purity, and the thereby determined characteristics of the coatings deposited according to the present invention, such as average internal stress, average lattice (crystal) distortion, as well as the crystallite size, are thus equal to the galvanically deposited coatings.

The bath according to the present invention therefore makes possible, in particular, the manufacture of printed circuit boards with adhered layers, which are extremely ductile and solderable, and which are characterized by lowest internal strains. This signifies a technological breakthrough.

The complex formers to be employed according to the present invention display, moreover, the particular advantage of being easily biologically degradable, and thereby particularly environmentally friendly in contrast to the known complex formers. Thus, for example, with the glycerin to be employed according to the present invention, no harmful effect on organisms has been known, so that it provides, under further consideration of its character as a substance to be classified as highly biologically degradable, favorable ecological characteristics.

Examples of compounds of copper, nickel and cobalt that can be employed in the bath are their sulfates, nitrates, chlorides, bromides, rhodanides, oxides, hydroxides, carbonates, basic carbonates, acetates, among others. They are employed in the bath in metal concentrations from $10^{-4}$ up to 2 mol/liter, preferably from $10^{-2}$ up to 1 mol/liter. These metal compounds form, with the complex formers according to the present invention, complex compounds in the bath solution, which provide the desired activity. It is self-evident, however, that these complex compounds can also be manufactured in known manner and then first added to the bath solution before their employment.

For example, the complex compound according to the present invention, (Schiff-like) potassium-copper-biuret, can be prepared by means of addition of 1 mol copper acetate to an aqueous solution of 1 mol biuret and 4 mol potassium hydroxide, through precipitation with 2% alcoholic potassium hydroxide solution.

It has proven to be particularly advantageous when the molar ratio of metal to complex former amounts to at least 1:0.8, preferably from 1:1 to 1:6.

Suitable as complex formers according to the present invention are also polyols which are characterized by the general formula $$R-\underset{\underset{OH}{|}}{(CH)}_n-R$$

in which R is hydrogen or $C_1$–$C_6$-alkyl, and n is an integer from 2 to 8.

Examples of such polyols include ethylene glycol, glycerine, erythrite, arabite, mannite, dulcite, sorbite, polyvinyl alcohol, inosite, 3,4-dihydroxytetrahydrofuran and maltite.

Complex formers of the biuret type according to the present invention should be understood to include those which contain in the molecule at least two of the following groups:

$$-\overset{O}{\overset{\|}{C}}-NH_2,\ -\overset{NH}{\overset{\|}{C}}-NH_2 \text{ or } -\overset{S}{\overset{\|}{C}}-NH_2,$$

which are bound in open chain and directly with each other or through a C- or N-atom.

The stability of the metal complexes formed from these complex formers is extraordinarlly great. It can, however, be influenced by alteration of the pH-value by means of acidification, if desired, to such an extent whereby there occurs complete precipitation of the metal hydroxide, which can then again be introduced into the manufacturing process.

The pH-value of the bath according to the present invention should amount to greater than 10, preferably from 12 to 14, and is held to the desired value by means of the addition of customary pH-regulating substances or substance mixtures.

Suitable as reducing agent in the bath according to the present invention are, particularly, formaldehyde, sodium borohydride, dimethylaminoborane, diethylaminoborane, sodium hypophosphite, hydrazine, glycerine aldehyde, dihydroxyacetone, as well as other customary reducing agents.

In the method according to the present invention for the adhesive chemical deposition of copper, nickel, cobalt or their alloys, the bath is operated at a temperature from 5° C. up to the boiling point, preferably from 20° to 80° C.

To the extent desired, the bath can additionally contain known stabilizers based upon polyamines, N-containing compounds, reaction products of N-containing compounds with epihalohydrines, sulfur- or selenium compounds having an oxidation level of −1 or −2, mercury compounds or lead compounds, in order to assure a sufficient life span of the bath.

Suitable as wetting agent are all products which are known for this purpose.

The basic composition of the bath according to the present invention is as follows:

Metal compound(s): $10^{-2}$ up to 0.3 mol/liter

Reducing agent: $10^{-3}$ up to 1 mol/liter

Complex former(s): $10^{-3}$ up to 10 mol/liter

The bath according to the present invention is suitable for the complete or partial metallization of conductors and non-conductors, after appropriate customary pre-treatment, such as defatting, etching, cleaning, conditioning, activation and reduction. A preferred field of use is the manufacture of printed circuits.

The novel features which are considered characteristic for the invention are set forth in particular in the appended claims. The invention itself, however, both as to its construction and its method of operation, together with additional objects and advantages thereof, will be best understood from the following description of specific embodiments.

DESCRIPTION OF THE PREFERRED EMBODIMENTS

EXAMPLE 1

| | |
|---|---|
| Copper hydroxide carbonate $Cu(OH)_2 \times CuCO_3$ | 0.75 g Cu/l |
| Glycerine | 7 g/l |
| Biuret | 0.1 g/l |
| Formaldehyde, 30 vol. % | 12 ml/l |
| Sodium hydroxide | 12 g/l |
| Diethylthiourea | 0.006 g/l |
| Temperature (with blowing in of air and agitation of stock) | 28 ± 2° C. |

The conductors contacted in this bath are, as determined by the transmitted light technique, objection-free. The deposition velocity amounts to about 2 μm/h, so that a treatment period of 15–20 minutes total is sufficient. After lowering of the pH-value, by means of an acid, to pH 7–10, practically all of the copper precipitates as copper hydroxide. After filtration, it can again be dissolved directly in the bath.

EXAMPLE 2

| | |
|---|---|
| Copper chloride $CuCl_2$ | 2 g Cu/l |
| Glycerine | 12 g/l |
| Formaldehyde, 30 vol. % | 15 ml/l |
| Sodium hydroxide | 15 g/l |
| Polyvinyl alcohol | 0.07 g/l |
| Thiophosphoric acid ethyl ester | 0.5 g/l |
| Temperature (with blowing in of air and agitation of stock) | 55–60° C. |

This bath deposits ductile copper coatings at a velocity of about 5 μm/h, which are particularly suitable for the semi-additive or additive technique.

EXAMPLE 3

| | |
|---|---|
| Copper sulfate $CuSO_4 \times 5H_2O$ | 1.5 g/l Cu |
| Sorbitol, 70% | 5 ml/l |
| Sodium hypophosphite | 40 g/l |
| Sodium hydroxide | 7 g/l |
| Temperature | 60 ± 2° C. |

Copper-phosphorus alloys are deposited from this bath, having 0.3 to 0.5% phosphorus. The deposition velocity amounts to 1.2 μm/h.

EXAMPLE 4

| | |
|---|---|
| Copper sulfate $CuSO_4 \times 5H_2O$ | 1 g Cu/l |
| Glycerine | 5 g/l |
| Sodium hypophosphite | 40 g/l |
| Sodium hydroxide | 15 g/l |
| Temperature | 55° C. |

From this bath, one can deposit adhesive layers of $Cu_2O$ onto $Al_2O_3$-ceramic. After a tempering process at 400° to 600° C., the layers are increased, within a ten minute period, to 30 um, in an acid galvanic copper bath. By means of the tempering and spinel formation, an increase in adhesion of up to 2 N/mm is provided, as determined by the peel test. With the customary techniques, without spinel formation, one obtains an adhesion of only 0.7 N/mm.

EXAMPLE 5

| | |
|---|---|
| Nickel chloride $NiCl_2 \times 6H_2O$ | 1 g Ni/l |
| Biuret | 6 g/l |
| Sodium borohydride | 3 g/l |
| Sodium hydroxide | 30 g/l |
| Temperature | 90 ± 5° C. |

From this bath, one can deposit ductile nickel coatings with a content of boron of about 0.2 to 0.4%.

It will be understood that each of the elements described above, or two or more together, may also find a useful application in other types of deposition differing from the types described above.

While the invention has been illustrated and described as embodied in an aqueous alkaline bath for the chemical deposition of copper, nickel, cobalt or their alloys, and a deposition method employing the same, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. In an aqueous alkaline bath for adhesive chemical deposition of copper containing a copper compound, reducing agent, wetting agent, pH-regulating substance, stabilizer, inhibitor and complex former, the improvement for deposition of copper with greater purity onto printed circuits, wherein said complex former comprises (a) sorbitol or glycerin, in mixture with (b) biuret, in a molar ratio of metal to complex former from 1:0.8 up to 1:6.

2. The aqueous alkaline bath according to claim 1, containing as reducing agent a member selected from the group consisting of formaldehyde, sodium borohydride, dimethylaminoborane, diethylaminoborane, sodium-hypophosphite, hydrazine, glycerine aldehyde and dihydroxyacetone.

3. The aqueous alkaline bath according to claim 1, containing as stabilizer a polyamine, an N-containing compound, a reaction product of an N-containing compound with epihalohydrine, a sulfur- or selenium compound having an oxidation level of $-1$ or $-2$, a mercury compound or a lead compound.

4. The aqueous alkaline bath according to claim 3, containing as stabilizer cyanide or a complex-cyanide.

5. The aqueous alkaline bath according to claim 1, said complex is present in a concentration from $10^{-4}$ up to 2 mol/liter.

6. The aqueous alkaline bath according to claim 5, said concentration is from $10^{-2}$ up to 1 mol/liter.

7. The aqueous alkaline bath according to claim 1, characterized by a molar ratio of metal to complex former of 1:1.

8. The aqueous alkaline bath according to claim 1, having a pH-value greater than 10.

9. The aqueous alkaline bath according to claim 8, said pH-value is from 12 to 14.

10. Method for adhesive chemical deposition of copper onto printed circuits, comprising placing a printed circuit into the bath according to claim 1, said bath is utilized at a temperature from 5° C. to the boiling point thereof.

11. The method according to claim 10, said bath is utilized at a temperature between 20° C. and 80° C.

* * * * *